US005509466A

United States Patent [19]

McQuade et al.

[11] Patent Number: 5,509,466

[45] Date of Patent: Apr. 23, 1996

[54] CONDENSER WITH DRAINAGE MEMBER FOR REDUCING THE VOLUME OF LIQUID IN THE RESERVOIR

[75] Inventors: William F. McQuade, Mechanicsburg; Keith E. Starner; Mark A. Adams, both of York, all of Pa.

[73] Assignee: York International Corporation, York, Pa.

[21] Appl. No.: 338,809

[22] Filed: Nov. 10, 1994

[51] Int. Cl.[6] ..... F28B 1/02

[52] U.S. Cl. ..... 165/113; 165/112; 165/DIG. 212; 165/DIG. 205

[58] Field of Search ..... 165/110, 112, 165/113, DIG. 192, DIG. 212, DIG. 213

[56] References Cited

U.S. PATENT DOCUMENTS

| | | | |
|---|---|---|---|
| 888,637 | 5/1908 | Morison | 165/113 |
| 956,210 | 4/1910 | Snow | 165/DIG. 212 |
| 1,233,138 | 7/1917 | Snow | 165/114 |
| 1,855,390 | 4/1932 | Ehrhart | 165/113 |
| 1,917,595 | 7/1933 | McDermet . | |
| 2,830,797 | 4/1958 | Garland | 165/113 |
| 2,916,264 | 12/1959 | Rhodes | 257/239 |
| 2,919,903 | 1/1960 | Vautrain et al. | 257/32 |
| 3,020,024 | 2/1962 | Lawrance | 257/32 |
| 3,048,373 | 8/1962 | Buaer et al. | 257/239 |
| 3,749,160 | 7/1973 | Vestre . | |
| 4,252,186 | 2/1981 | Starner et al. | 165/114 |

FOREIGN PATENT DOCUMENTS

| | | | |
|---|---|---|---|
| 60-57191 | 4/1985 | Japan | 165/113 |
| 173637 | 7/1908 | United Kingdom | 165/113 |

*Primary Examiner*—Allen J. Flanigan

*Attorney, Agent, or Firm*—Finnegan, Henderson, Farabow, Garrett & Dunner

[57] ABSTRACT

The condenser has a condenser shell with a reservoir portion, condenser tubes for cooling vapor flowing over the condenser tubes to condense the vapor to a liquid, and subcooler tubes in a subcooler compartment for cooling liquid within the reservoir portion. The condenser includes a drainage member for forming a void in the reservoir portion and having an upper surface inclined relative to a horizontal plane for directing the liquid from the condenser tubes toward the entrance to the subcooler compartment. The drainage member reduces the amount of liquid required in the reservoir for efficient subcooler and system operation by occupying space in the liquid reservoir that normally is occupied by liquid.

12 Claims, 5 Drawing Sheets

CONDENSER WITH DRAINAGE MEMBER FOR REDUCING THE VOLUME OF LIQUID IN THE RESERVOIR

BACKGROUND OF THE INVENTION

1. Field of the Invention

The present invention relates to a condenser. More particularly, the present invention relates to a shell and tube condenser for condensing vapor to liquid and having a subcooler for cooling the condensed liquid below the saturation temperature.

2. Description of the Related Art

In conventional condensers, such as condenser 10A shown in FIG. 1, condenser tubes 30A reduce the temperature of vapor entering the condenser, causing vapor to condense to liquid. Before the liquid leaves the condenser 10A, it is further cooled by subcooler tubes 50A positioned in a subcooler compartment 40A. The subcooler compartment 40A controls the flow of the liquid over the subcooler tubes 50A.

Preferably, no vapor enters the subcooler compartment 40A. Allowing vapor to enter the subcooler compartment 40A decreases the efficiency of the subcooler because the rate of convection heat transfer in the vapor phase is much less than in the liquid phase. Further, allowing vapor to enter the subcooler compartment 40A may allow vapor to leave the condenser 10A, thereby decreasing the efficiency of the system.

Engulfing the subcooler compartment 40A in a liquid reservoir 70A that extends along the full length of the condenser 10A will form a liquid seal that prevents vapor from entering the subcooler compartment. As illustrated in FIG. 1, the reservoir 70A must extend well above the entrance to the subcooler compartment 40A to prevent vapor from being entrained in the liquid flowing into the subcooler compartment. For example, the reservoir 70A must extend far enough above the entrance to prevent vapor within vortex 75A, which is typically formed at high flow rates, from entering the subcooler compartment.

The large reservoir of liquid required to form the seal can contribute significantly to the initial and operating costs of the condenser. For example, refrigerant has become very expensive due to industry changes that require it to be environmentally sound. Thus, the large reservoir of liquid refrigerant needed in a refrigerant condenser significantly increases its initial and operating costs.

SUMMARY OF THE INVENTION

An object of the invention is to decrease the volume of liquid in condenser reservoirs without decreasing condenser efficiency.

Another object of the invention is to decrease the initial and operating costs of condensers.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a condenser including a condenser shell having a reservoir portion, condenser tubes for cooling vapor flowing over the condenser tubes to cause the vapor to condense to a liquid and flow into the reservoir portion, subcooler tubes for cooling liquid in the reservoir portion, a subcooler compartment for housing the subcooler tubes, the subcooler compartment having an entrance through which the liquid within the reservoir portion flows into the subcooler compartment and over the subcooler tubes, and a drainage member for forming a void in the reservoir portion and having an upper surface inclined relative to a horizontal plane for directing the liquid from the condenser tubes toward the entrance to the subcooler compartment.

The condenser of the present invention requires less liquid to fill the reservoir portion because the drainage member occupies space in the reservoir portion. Thus, the condenser uses less liquid to form the liquid seal required for efficient subcooler and system operation.

It is to be understood that both the foregoing general description and the following detailed description are exemplary and explanatory only and are not restrictive of the invention, as claimed.

The accompanying drawings, which are incorporated in and constitute a part of this specification, illustrate one embodiment of the invention and together with the description, serve to explain the principles of the invention.

DESCRIPTION OF THE PREFERRED EMBODIMENT

Reference will now be made in detail to the present preferred embodiment of the invention, an example of which is illustrated in the accompanying drawings. Wherever possible, the same reference numbers will be used throughout the drawings to refer to the same or like parts.

The present invention relates to a condenser that condenses vapor to liquid. The condenser of the present invention is preferably of the shell and tube configuration and is particularly advantageous when used to condense refrigerant vapor. However, it can be used to condense other vapors such as, for example, water or petroleum products.

Figure 1:
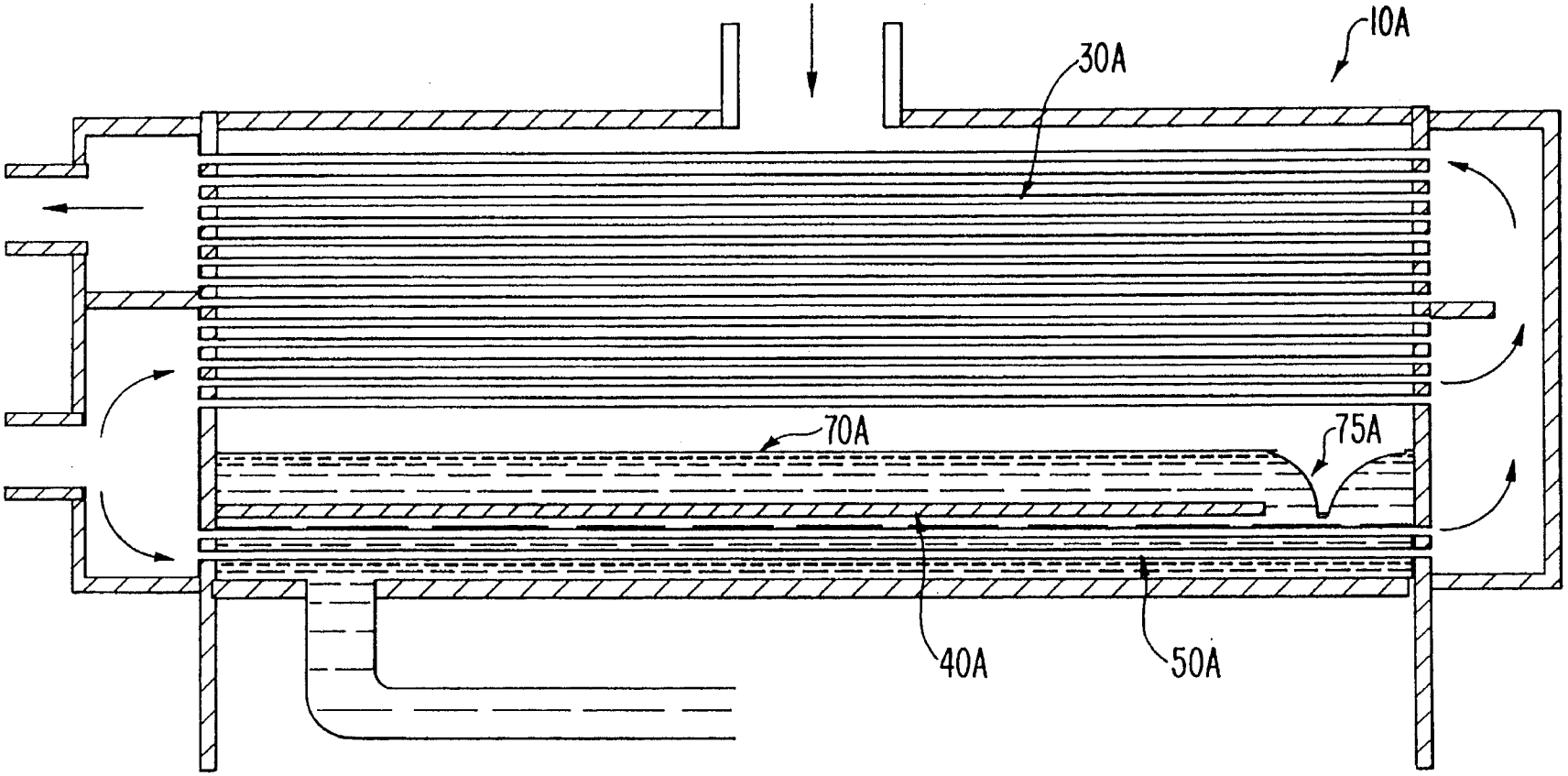
FIG. 1 (PRIOR ART)
FIG. 1 is a section view of a prior art condenser.
Figure 2:
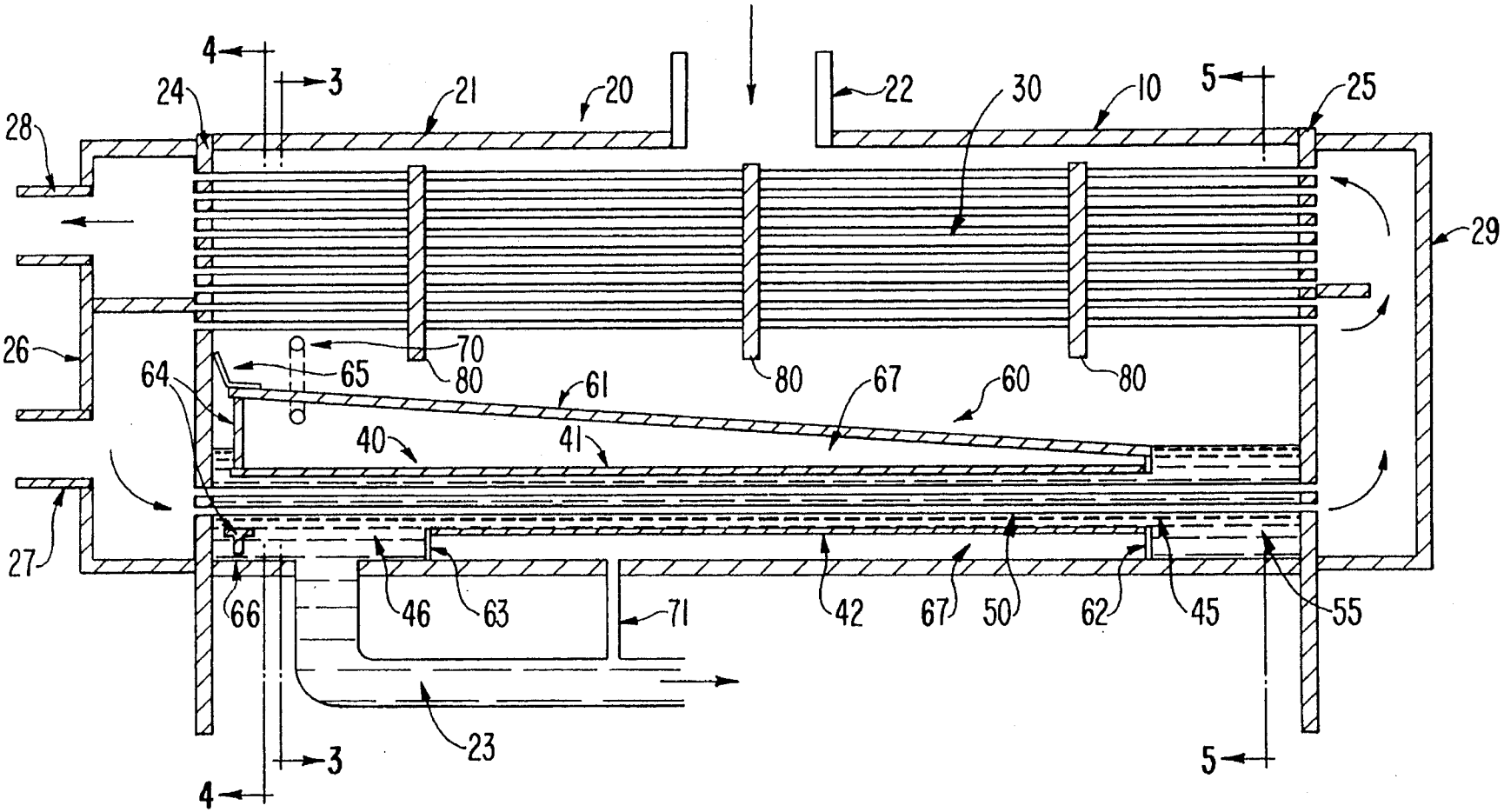
FIG. 2 is a section view of an embodiment of the condenser of the present invention.

A preferred embodiment of the condenser of the present invention is shown in FIG. 2 and is designated generally by the reference numeral 10. In accordance with the invention, condenser 10 includes a condenser shell with a reservoir portion, condenser tubes for cooling vapor to condense it to a liquid, subcooler tubes for cooling liquid in the reservoir portion, a subcooler compartment for housing the subcooler tubes, and a drainage member for forming a void in the reservoir portion and directing the liquid toward the entrance to the subcooler compartment.

As embodied herein, condenser shell 20 includes header plates 24 and 25 positioned at opposing ends of an elongated, substantially cylindrical casing 21. A vapor inlet 22 and a liquid outlet 23 allow vapor to enter and liquid to exit condenser shell 20, respectively.

Vapor entering condenser shell 20 through vapor inlet 22 flows over condenser tubes 30. As embodied herein, condenser tubes 30 are a bundle of tubes extending substantially in the horizontal direction between header plates 24 and 25. Coolant flowing through condenser tubes 30 causes them to cool and condense the vapor to a liquid.

Figure 3:
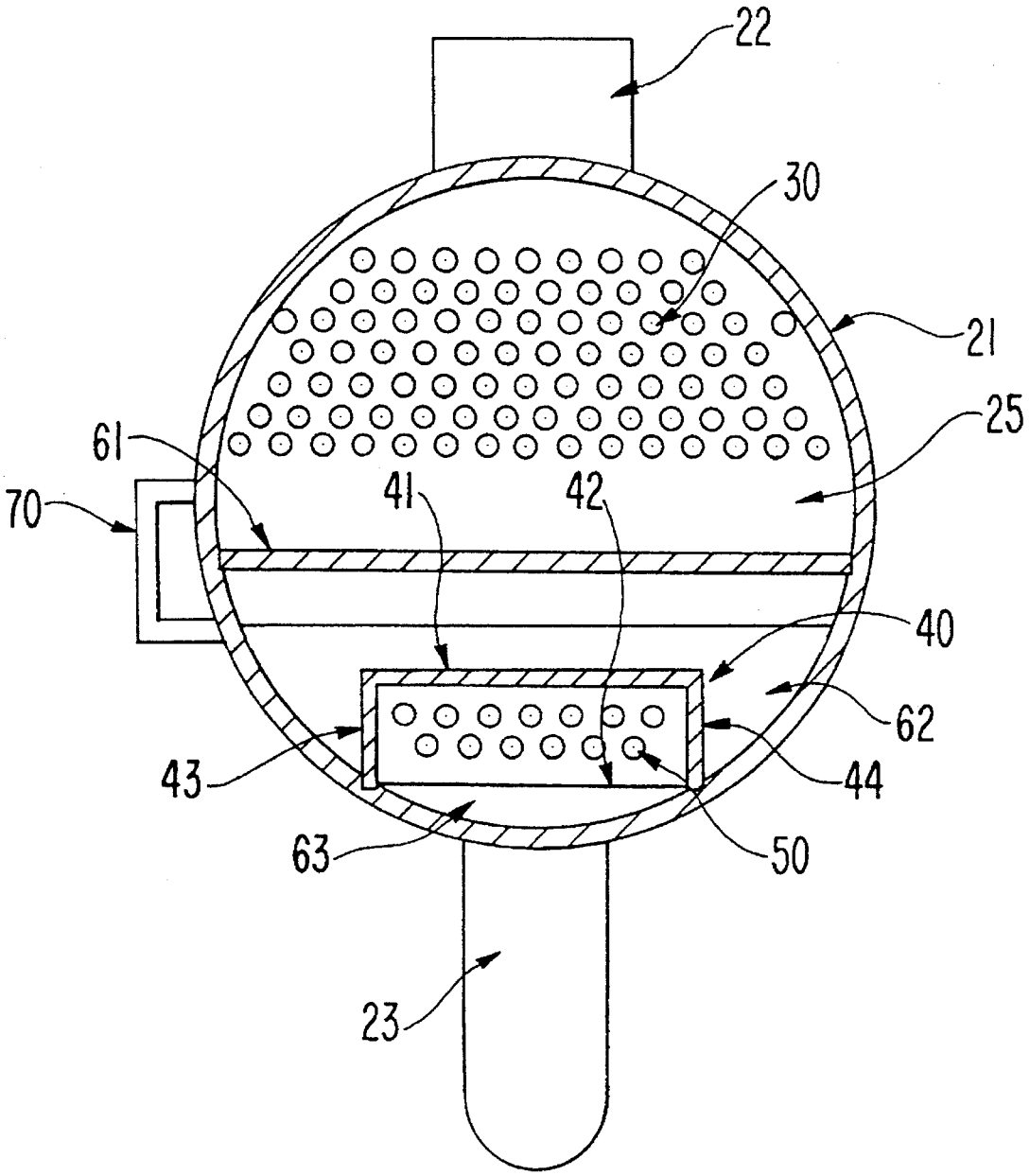
FIG. 3 is a section view of the condenser taken along line 3—3 of FIG. 2.

The liquid collects in a reservoir portion 55 and forms a liquid seal at the entrance 45 to subcooler compartment 40. As embodied herein, subcooler compartment 40 includes a substantially rectangular upper wall 41, lower wall 42, side wall 43, and side wall 44 (FIG. 3). Liquid collected in reservoir portion 55 enters subcooler compartment 40 through entrance 45, is guided axially over subcooler tubes 50 by walls 41, 42, 43, and 44, and exits through exit 46 to the liquid outlet 23 of condenser shell 20.

The subcooler tubes 50 cool the liquid that passes through subcooler compartment 40. As embodied herein, the subcooler tubes 50 are a bundle of tubes connected at opposing ends to header plates 24 and 25 and extending substantially in the horizontal direction. Coolant flowing through subcooler tubes 50 preferably causes them to cool the liquid below the saturation temperature.

Water is the preferred coolant flowing through condenser tubes 30 and subcooler tubes 50, but other coolants could be used to practice the invention. The preferred system for distributing coolant through condenser tubes 30 and subcooler tubes 50 includes a pair of boxes 26 and 29 connected to header plates 24 and 25, respectively. Coolant enters box 26 through coolant inlet 27 and is distributed through subcooler tubes 50 and some of the lower condenser tubes 30. The coolant next passes through box 29 and enters the remaining condenser tubes 30. The coolant exits through coolant outlet 28 on box 26.

Though the above described coolant distribution system is preferred, others could be used to practice the invention. For example, coolant can enter into a box attached to header plate 24, be distributed through all condenser and subcooler tubes, and then exit through a box attached to header plate 25.

The condenser of the present invention includes a drainage member for reducing the volume of liquid required to form the reservoir that seals subcooler entrance 45. As embodied herein, drainage member 60 includes a drainage plate 61, face plate 62, intermediate plate 63, and back plate 64 that form a void 67 in reservoir portion 55. The term "void" is used herein to refer to the absence of condensate. Preferably, vapor occupies void 67. However, it could be occupied by other fill materials.

Drainage plate 61 forms an upper surface inclined relative to a horizontal plane that directs condensate from condenser tubes 30 toward subcooler entrance 45. As shown in FIG. 2, drainage plate 61 preferably extends from header plate 24 to subcooler entrance 45. As shown in FIG. 3, drainage plate 61 preferably extends from one side of casing 21 to the other. Welding the edges of drainage plate 61 to face plate 62 and to casing 21 forms seals that prevent liquid from entering void 67. A seal is formed at an upper end of drainage plate 61 by welding it to an angled sealing strip 65, which abuts header plate 24.

The angle of inclination between drainage plate 61 and the horizontal plane was analytically designed using open channel flow theory. Preferably, an angle within the range of 2° to 5° is formed between drainage plate 61 and the horizontal plane. The optimum value of the angle depends on the volume flow rate of the liquid, width of the condenser shell, and axial distribution of the condensate along the shell. This angle increases the rate of drainage by assigning an additional gravitational component to the forces acting on the liquid. For a fixed tonnage (and therefore fixed volume flow rate) system, this additional force reduces the height of liquid flowing down drainage plate 61.

The reduced height of the liquid on drainage plate 61 aids the flow of liquid. For example, tube support plates 80 extend just above drainage plate 61. At the upper end of drainage plate 61, support plates 80 can be sufficiently close to drainage plate 61 to impede the flow of liquid. Due to the reduced liquid height resulting from the preferred angle of inclination, the support plates 80 do not impede the flow of liquid in the present invention.

Face plate 62 prevents the liquid in reservoir portion 55 from flowing into void 67. Face plate 62 preferably extends substantially perpendicular to the horizontal plane. As shown in FIG. 2, the inner edges of face plate 62 are preferably welded to subcooler compartment 40 at entrance 45 and the outer edges are preferably welded to casing 21 and to drainage plate 61.

Intermediate plate 63 prevents liquid in subcooler exit 46 from flowing into void 67. Intermediate plate 63 preferably extends substantially perpendicular to the horizontal plane and is welded between casing 21 and lower wall 42 of subcooler compartment 40.

Figure 4:
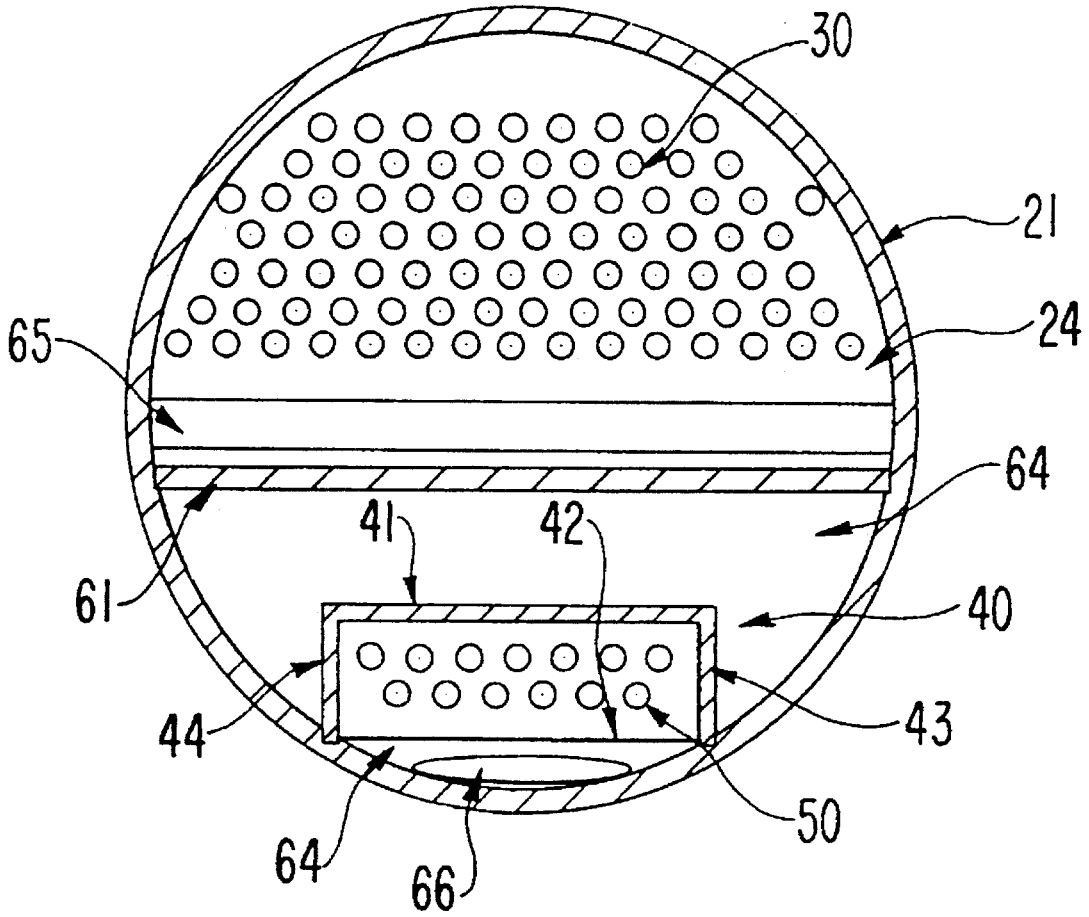
FIG. 4 is a section view of the condenser taken along line 4—4 of FIG. 2.
Figure 5:
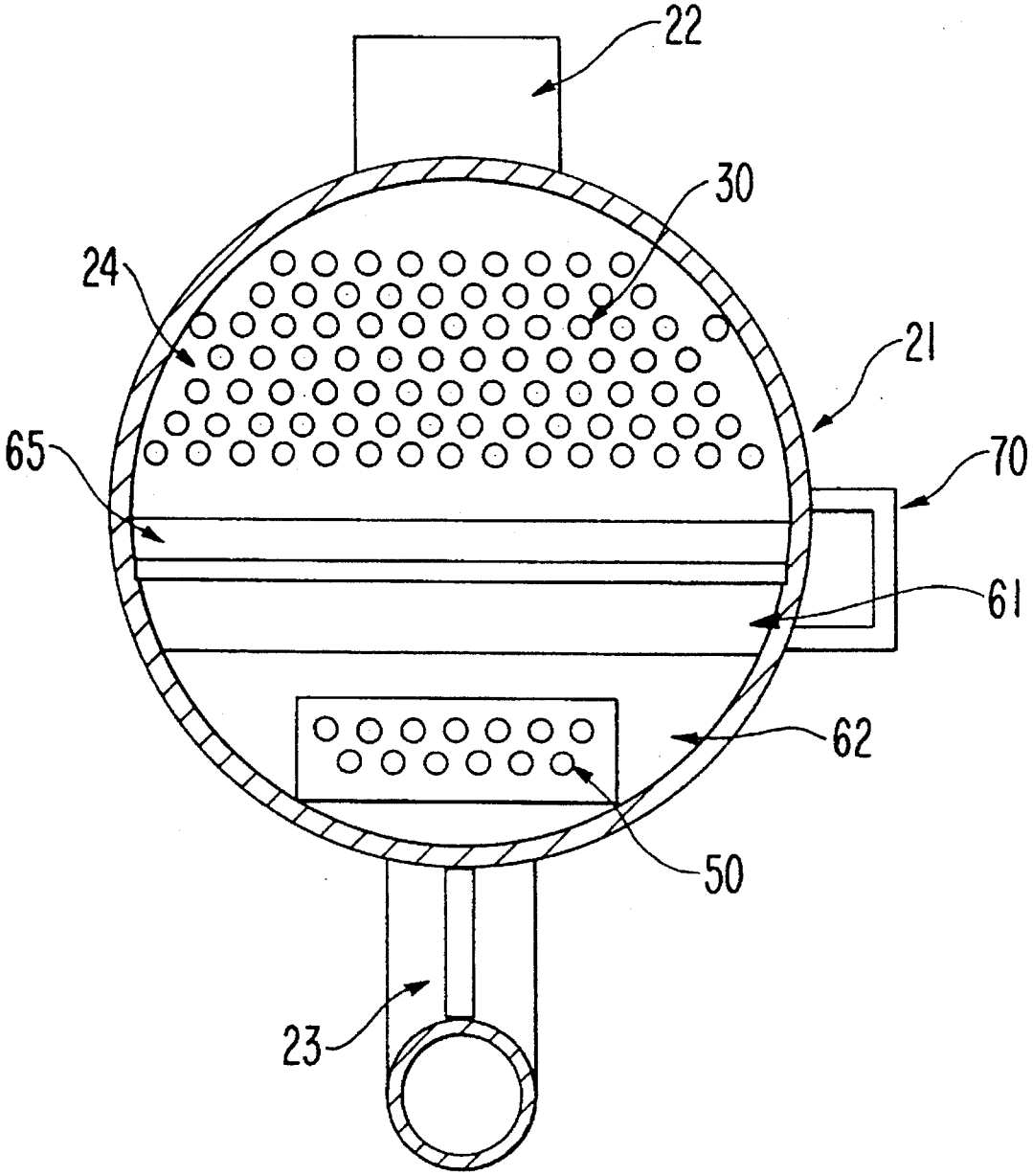
FIG. 5 is a section view of the condenser taken along line 5—5 of FIG. 2.

The upper portion of back plate 64 prevents liquid in reservoir portion 55 from flowing into void 67. Back plate 64 preferably extends substantially perpendicular to the horizontal plane. As shown in FIG. 4, back plate 64 is preferably welded along its top to drainage plate 61 and along its outer edges to casing 21. The inner edges of back plate 64 are preferably welded to the periphery of the walls of subcooler compartment 40. As shown in FIGS. 2 and 4, a liquid passage 66 is provided between the bottom of condenser shell 20 and back plate 64. Since this liquid in the opening is subject to slightly lower pressure than the vapor around condenser tubes 30, any liquid that may have found its way behind angled sealing strip 65 can drain back into subcooler compartment 40.

Drainage member 60 occupies space in reservoir portion 55 that otherwise would be occupied by liquid. Thus, drainage member 60 reduces the amount of liquid required in reservoir portion 55 to provide a liquid seal at subcooler entrance 45. Accordingly, the condenser of the present invention requires less liquid in the reservoir than conventional condensers, yet provides similar subcooler and system efficiency. The void 67 created in the reservoir by drainage member 60 can reduce the amount of liquid needed to maintain a liquid seal by an average of 16–25%.

As shown in FIGS. 2 and 3, a vapor vent 70 and a liquid drain 71 are preferably provided to remove any vapor or liquid, respectively, that may enter void 67. As embodied herein, vapor vent 70 is a tube that connects void 67 to the area surrounding condenser tubes 30, thereby allowing vapor in void 67 to flow toward condenser tubes 30. As embodied herein, liquid drain 71 is a tube that connects void 67 to liquid outlet 23, thereby allowing liquid in void 67 to drain into liquid outlet 23.

It will be apparent to those skilled in the art that various modifications and variations can be made in the condenser of the present invention without departing from the scope or spirit of the invention. For example, the invention could also be practiced with a condenser having a subcooler compartment and subcooler tubes located outside the condenser shell. In such an arrangement, the entrance to the subcooler compartment 40 remains within the condenser shell, thereby requiring a liquid seal provided by a reservoir. Thus, the invention is useful in reducing the amount of liquid required to fill that reservoir.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A condenser comprising:

a condenser shell having a reservoir portion;

a vapor inlet through which vapor enters the condenser shell;

condenser tubes for cooling vapor flowing over the condenser tubes to cause the vapor to condense to a liquid and flow into the reservoir portion;

subcooler tubes for cooling liquid in the reservoir portion;

a subcooler compartment for housing the subcooler tubes, the subcooler compartment having an entrance through which the liquid within the reservoir portion flows into the subcooler compartment and over the subcooler tubes; and a drainage member for forming a void in the reservoir portion and having an upper surface inclined relative to a horizontal plane for directing the liquid from the condenser tubes toward the entrance to the subcooler compartment.

2. The condenser of claim 1, wherein an angle within the range of 2° to 5° is formed between the upper surface and the horizontal plane.

3. The condenser of claim 1, wherein the drainage member includes a drainage plate for preventing liquid from entering the void, wherein the drainage plate forms the upper surface of the drainage member.

4. The condenser of claim 3, wherein the drainage plate extends from an end of the condenser shell to the entrance to the subcooler compartment and extends from one side of the condenser shell to another side.

5. The condenser of claim 3, wherein the drainage plate is substantially flat.

6. The condenser of claim 3, further comprising a face plate for preventing liquid from entering the void, wherein the face plate is connected to the drainage plate and the entrance to the subcooler compartment.

7. The condenser of claim 6, wherein the face plate extends substantially perpendicular to the horizontal plane.

8. The condenser of claim 1, wherein vapor occupies the void.

9. The condenser of claim 1, further comprising a liquid drain line for draining liquid from the void.

10. The condenser of claim 1, further comprising a vapor vent line for allowing vapor in the void to leave the void and flow over the condenser tubes.

11. The condenser of claim 1, wherein the subcooler tubes and subcooler compartment are positioned within the condenser shell.

12. The condenser of claim 1, wherein the vapor is refrigerant.

* * * * *